United States Patent [19]

Marsh et al.

[11] 4,444,139

[45] Apr. 24, 1984

[54] ARRANGEMENT FOR SECURING IN A SLIDE PLATE HOLD-DOWN SPRING IN A SEWING MACHINE BED

[75] Inventors: Walter H. W. Marsh, Scotch Plains; John Patricia, Elizabeth; Alfred Mack, Bayonne, all of N.J.

[73] Assignee: The Singer Company, Stamford, Conn.

[21] Appl. No.: 448,669

[22] Filed: Dec. 10, 1982

[51] Int. Cl.[3] ..... D05B 73/12

[52] U.S. Cl. ..... 112/260

[58] Field of Search ..... 112/13, 260

[56] References Cited

U.S. PATENT DOCUMENTS

| | | | |
|---|---|---|---|
| 894,210 | 7/1908 | Karle | 428/594 |
| 937,112 | 10/1909 | Stafford | 112/260 |
| 2,883,953 | 4/1959 | Johnson | 112/228 |
| 3,066,627 | 12/1962 | Schlosser et al. | 112/260 |
| 3,587,494 | 6/1971 | Ivanko | 112/184 |

FOREIGN PATENT DOCUMENTS

| | | |
|---|---|---|
| 43-7772 | 11/1965 | Japan . |
| 45-16921 | 5/1967 | Japan . |
| 45-16102 | 7/1970 | Japan . |

*Primary Examiner*—Wm. Carter Reynolds

*Attorney, Agent, or Firm*—William V. Ebs; Robert E. Smith; Edward L. Bell

[57] ABSTRACT

A slide plate hold-down spring is provided with a depending portion which is received in a well in a sewing machine bed. The depending portion includes a window in which a protuberance on the bed engages the spring, and a curved length which engages a wall of the well.

7 Claims, 7 Drawing Figures

ARRANGEMENT FOR SECURING IN A SLIDE PLATE HOLD-DOWN SPRING IN A SEWING MACHINE BED

BACKGROUND OF THE INVENTION

1. Field of the Invention

The invention is directed to an arrangement for securing a slide plate hold-down spring in the bed of a sewing machine.

2. Description of the Prior Art

It is well known to hold down a slide plate in the bed of a sewing machine with a spring which is affixed to the bed, and has side extending wings to engage the plate in grooves above the elevation of a seat in the bed for the slide. Such a hold-down spring has commonly been affixed to the bed with a screw and this has proved to be a reliable attaching means when the bed is a cast metal part. However, the use of a fiber glass bed is now preferable in many sewing machine models, and when the bed is constructed from such a plastic material the use of a screw to secure the slide plate hold-down spring to the bed is no longer satisfactory due to the ease with which threads in the bed may be damaged both during installation of the spring in the bed and thereafter.

It is a prime object of the present invention to provide an improved arrangement not requiring the use of screws for securing a slide plate hold-down spring in the bed of a sewing machine.

It is another object of the invention to provide a self-locking arrangement for a slide plate hold-down spring in the bed of a sewing machine, and to thereby define a fixed position for the spring in the bed without the need for fastners extending into the bed structure.

Other objects and advantages of the invention will become apparent during a reading of the specification taken in conjunction with the accompanying drawings.

SUMMARY OF THE INVENTION

A slide plate hold-down spring having wings which engage a slide plate above the elevation of a seat for the plate in the bed of a sewing machine is formed with a depending portion which is received in a well in the bed and which extends therein into engagement with a wall on one side of the well. A protuberance is provided on a wall on the other side of the wall, and the depending spring portion is formed with a window in which the protuberance engages the spring to prevent upward movement of the spring.

DESCRIPTION OF THE PREFERRED EMBODIMENT OF THE INVENTION

Figure 1:
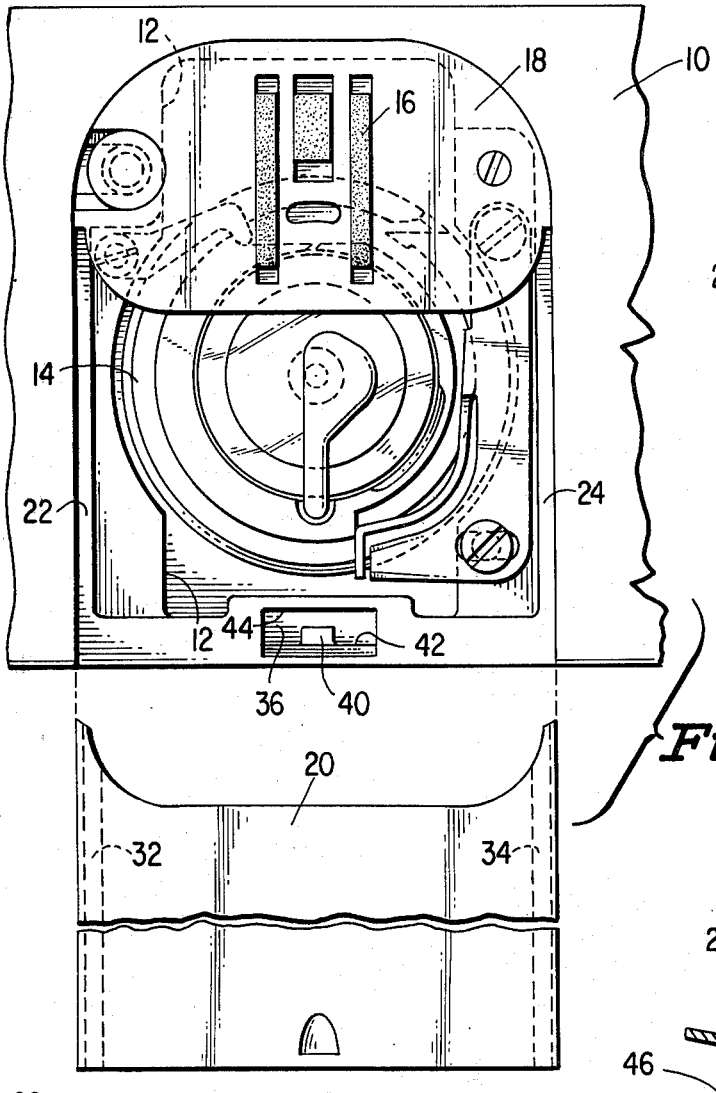
FIG. 1 is a top plan view of a portion of a sewing machine bed including a well for a slide plate hold-down spring constructed according to the invention.
Figure 2:
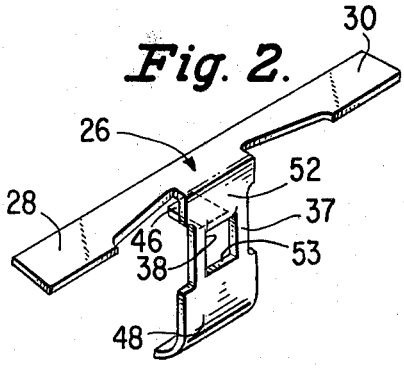
FIG. 2 is a prespective view of the slide plate hold-down spring.

Referring to FIG. 1 of the drawings, there may be seen a portion of a sewing machine bed 10 in the region of a cavity 12 wherein the loop taker 14 and feed dog 16 of the machine are located. A throat plate 18 is shown partially covering the cavity 12, and a bed slide plate 20 is shown for use in completing closure of the cavity and providing a work supporting surface for material to be sewn. Ways 22 and 24, at opposite sides of cavity 12, provide a seat upon which plate 20 may be slid into place over cavity 12 or withdrawn from the machine. Slide plate 20, while on the bed, is held against the ways 22 and 24 by a hold-down spring 26 which is affixed in the bed and has wings 28 and 30 that extend into engagement above the elevation of the seat with the plate in grooves 32 and 34 formed by bent over side edge portions of the plate.

Spring 26 is peculiarly adapted for attachment in accordance with the invention to bed 10, within a well 36, provided in the bed between the ways 22 and 24 at the front of cavity 12. The spring, which is peculiarly formed from sheet steel as an integral structure, is provided under the wings 28 and 30 with a depending portion 37 which attaches to the bed.

Figure 6:
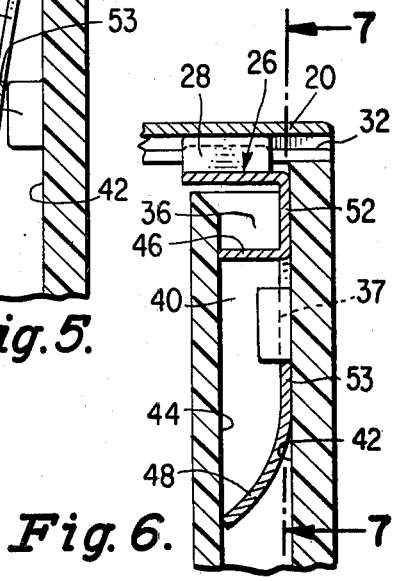
FIG. 6 is a sectional view taken on the plane of the line 4—4 of FIG. 3, and showing the hold-down spring in its installed position in the well of the bed of FIG. 1.

Such depending portion 37 is formed with a rectangularly shaped window 38 for a correspondingly shaped protuberance 40, which is formed on a front wall 42 of well 36, and extends part way toward the rear wall 44 therein. As shown, the depending portion 37 of the spring includes a tongue 46 and lower end portion 48. The tongue, which is at the level of the upper edge of window 38 and extends perendicularly from the back 52 of the spring is of such a length as to engage rear wall 44, of the well 36, when the spring is seated in a fixed position in the well against the front wall 42, as shown in FIG. 6. Lower portion 48 is curved and extends from engagement with the front wall 42 of the well into engagement with rear wall 44 in the installed position of the spring.

Figure 4:
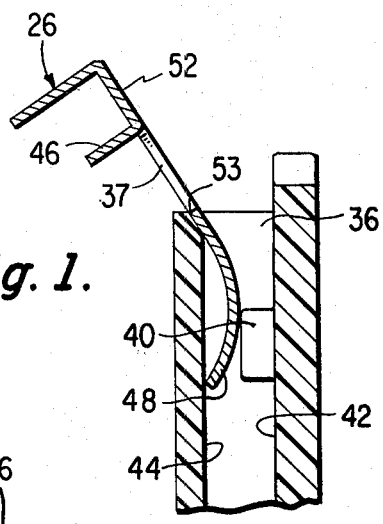
FIGS. 4 and 5 are sectional views taken on the plane of the line 4—4 of FIG. 3, and showing the hold-down spring in the process of installation.
Figure 3:
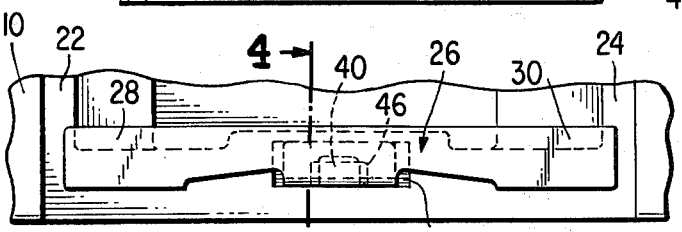
FIG. 3 is an enlarged fragmentary top plan view showing the hold-down spring installed in the sewing machine bed of FIG. 1.
Figure 5:
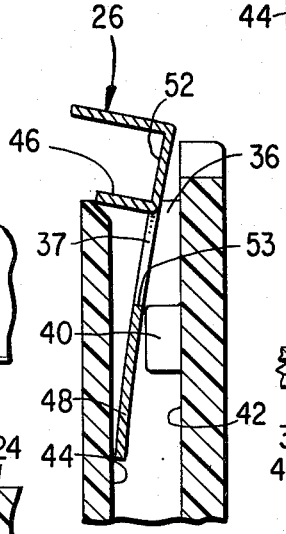
Figure 7:
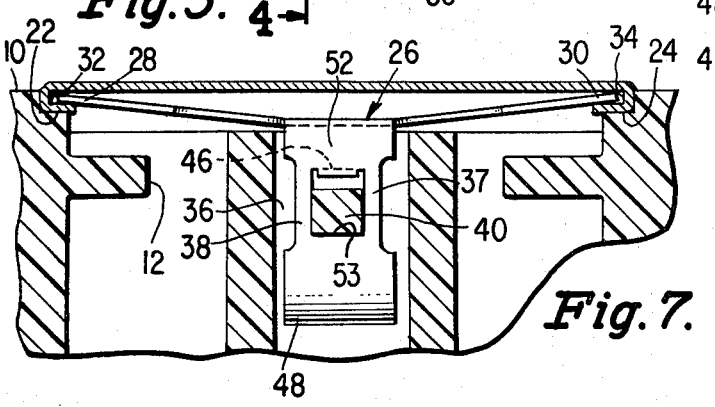
FIG. 7 is a fragmentary vertical, sectional view taken on the plane of the line 7—7 of FIG. 6, and showing the hold-down spring installed in the bed.

The spring 26 is affixed in the bed 10 by first inserting lower end portion 48 into well 36 and tilting the spring to permit the end portion 48 to pass between protuberance 40 and wall 44 (see FIG. 4). Sufficient pressure is then applied to the top of the spring to cause the spring to move downwardly in the well with some flexure of end portion 48 (FIG. 5). When the window 38 is aligned with protuberance 40, the spring seats in the FIG. 5 position wherein the back 52 of the spring is against the front wall 42 of the well, the tongue 46 and end portion 48 extend into engagement with rear wall 44 of the well, window sill 53 is under protuberance 40 extending through window 38, and the tongue 46 is over the protuberance. When the spring has been so disposed, it is self-locked in the bed and can be removed from the bed 10 only with the aid of a tool movable into well 36 from the bottom end and operable to flex the depending portion of the spring sufficiently to permit the sill 53 to pass over the protuberance 40 as the spring is pulled upwardly out of the well.

A plate 20, which has been separated from the bed by being slid off the ways 22 and 24, is repositioned in the bed for sewing by an operator first introducing ends of the wings 28 and 30 into the grooves 32 and 34, respectively, as the wings are slightly flexed upwardly as with the finger-nail or screw driver, to align the ends of the wings with the plate grooves. The plate 20 is then slid rearwardly on the ways into a position of engagement with the throat plate 18 to complete the closure of cavity 12. While the slide plate is on the bed, the engagement of sill 53 with the bottom of protuberance 40 prevents upward movement of the spring 26, and the wings 28 and 30 by acting downwardly on the slide plate 20 maintain such plate on the ways 22 and 24. During rearward movement of plate 20, that is toward throat plate 18, frictional force exerted by the plate 20, on the spring 26, is effectively balanced by a reaction at the line of engagement between tongue 46 and the rear wall 44 of the well 36, and the spring is thereby prevented from tilting rearwardly in the bed 10. During forward movement of plate 20, forward tilting by the spring is prevented by engagement of the back 52 of the spring with the front wall 42 of the well.

It is to be understood that the present disclosure relates to a preferred embodiment of the invention which is for purposes of illustration only and is not to be construed as a limitation of the invention. Numerous alterations and modifications of the structure herein disclosed will suggest themselves to those skilled in the art, and all such modifications and alterations which do not depart from the spirit and scope of the invention are intended to be included within the scope of the appended claims.

We claim:

1. In combination, a sewing machine bed including a well with a protuberance therein projecting from a wall of the well, a slide plate receivable on a seat provided in the bed, and a hold-down spring for the slide plate including wings to engage the slide plate above the elevation of the seat and apply a downward force to the plate, the depending portion of the spring including a window in which the protuberance engages the spring to prevent the spring from being moved upwardly, said depending portion of the spring being formed to extend into engagement in the well with a wall on the opposite side of the well from said protuberance.

2. The combination of claim 1 wherein the depending portion of the spring is curved into engagement with the wall on the opposite side of the well from the protuberance.

3. The combination of claim 1 wherein the depending portion of the spring includes a tongue above the window and a lower end portion under the window, both of which extend into engagement with the wall of the opposite side of the wall from the protuberance.

4. The combination of claim 3 wherein the tongue extends substantially perpendicular to the well wall engaged thereby.

5. The combination of claim 4 wherein said lower end portion is curved into engagement with the wall on the opposite side of the well from the protuberance.

6. The combination of claim 4 wherein the tongue and lower end portion are integral parts of the depending portion of the spring.

7. The combination of claim 6 wherein the depending portion of the spring is integral with the wings.

* * * * *

UNITED STATES PATENT OFFICE

CERTIFICATE OF CORRECTION

Patent No. 4,444,139 Dated April 24, 1984

Inventor(s) Marsh et al

It is certified that error appears in the above-identified patent and that said Letters Patent are hereby corrected as shown below:

In the Title, delete "in", first occurrence.

Signed and Sealed this

*Fourth* Day of *September 1984*

[SEAL]

*Attest:*

GERALD J. MOSSINGHOFF

*Attesting Officer*

*Commissioner of Patents and Trademarks*